US009157252B2

(12) United States Patent
School

(10) Patent No.: US 9,157,252 B2
(45) Date of Patent: Oct. 13, 2015

(54) NICHE-ASSIST INURNMENT SYSTEM

(71) Applicant: Terry School, Colorado Springs, CO (US)

(72) Inventor: Terry School, Colorado Springs, CO (US)

( * ) Notice: Subject to any disclaimer, the term of this patent is extended or adjusted under 35 U.S.C. 154(b) by 0 days.

(21) Appl. No.: 13/892,456

(22) Filed: Aug. 26, 2013

(65) Prior Publication Data

US 2015/0052830 A1 Feb. 26, 2015

(51) Int. Cl.
*E04F 19/00* (2006.01)
*E04H 13/00* (2006.01)

(52) U.S. Cl.
CPC ..... *E04H 13/006* (2013.01)

(58) Field of Classification Search
CPC ..... E04G 15/02; A47B 57/42; A47B 13/081
USPC ..... 52/136, 139, 128, 36.4, 73, 134; 248/235, 244, 250
See application file for complete search history.

(56) References Cited

U.S. PATENT DOCUMENTS

| | | | | | |
|---|---|---|---|---|---|
| 3,017,155 | A * | 1/1962 | Scarpetti | 248/235 |
| 3,916,477 | A * | 11/1975 | Baker, Sr. | 16/94 D |
| 4,285,484 | A * | 8/1981 | Follows | 248/235 |
| 4,960,308 | A * | 10/1990 | Donaghy | 312/404 |
| 5,257,766 | A * | 11/1993 | Riblet | 248/248 |
| 5,503,358 | A * | 4/1996 | Lapp | 248/235 |
| 6,098,566 | A * | 8/2000 | Metcalf | 114/362 |
| 6,349,507 | B1 * | 2/2002 | Muellerleile | 52/36.5 |
| 6,364,273 | B1 * | 4/2002 | Otema | 248/444.1 |
| 2006/0049323 | A1 * | 3/2006 | Anzai | 248/250 |

* cited by examiner

*Primary Examiner* — Brian Glessner
*Assistant Examiner* — Paola Agudelo

(57) ABSTRACT

A niche-assist inurnment system for simplifying the insertion of a cremation urn into a niche in a columbarium including a bracket, for temporary attachment to the frontal surface of the open niche, the bracket having an elongated body and a load supporting upper surface that slidingly supports a sled on which the cremation urn is placed and which is adapted to carry the urn into the niche and be retracted from the niche leaving the urn inside the niche.

5 Claims, 4 Drawing Sheets

NICHE-ASSIST INURNMENT SYSTEM

The present invention relates to a mechanical device for implementing the placement of crematory urns into the niche of a columbarium.

BACKGROUND

The dimensions of a columbarium niche are, of necessity, restricted and their openings are frequently not significantly greater than the crematory urn being deposited therein. The small clearance between the sides of the opening and the sides of the urn often cause physical and emotional distress with funeral personnel who are attempting to place the urn in the niche as a part of a solemn funeral proceeding.

It is therefore, the primary object of the present invention to provide a simple mechanism that can be quickly and temporarily attached to the columbarium niche into which the crematory urn is to be placed and by which the urn may be efficiently and unobtrusively slid into the niche on a sled that is retractable after the urn is positioned in the niche.

DETAILED DESCRIPTION OF PREFERRED EMBODIMENT

Figure 1:
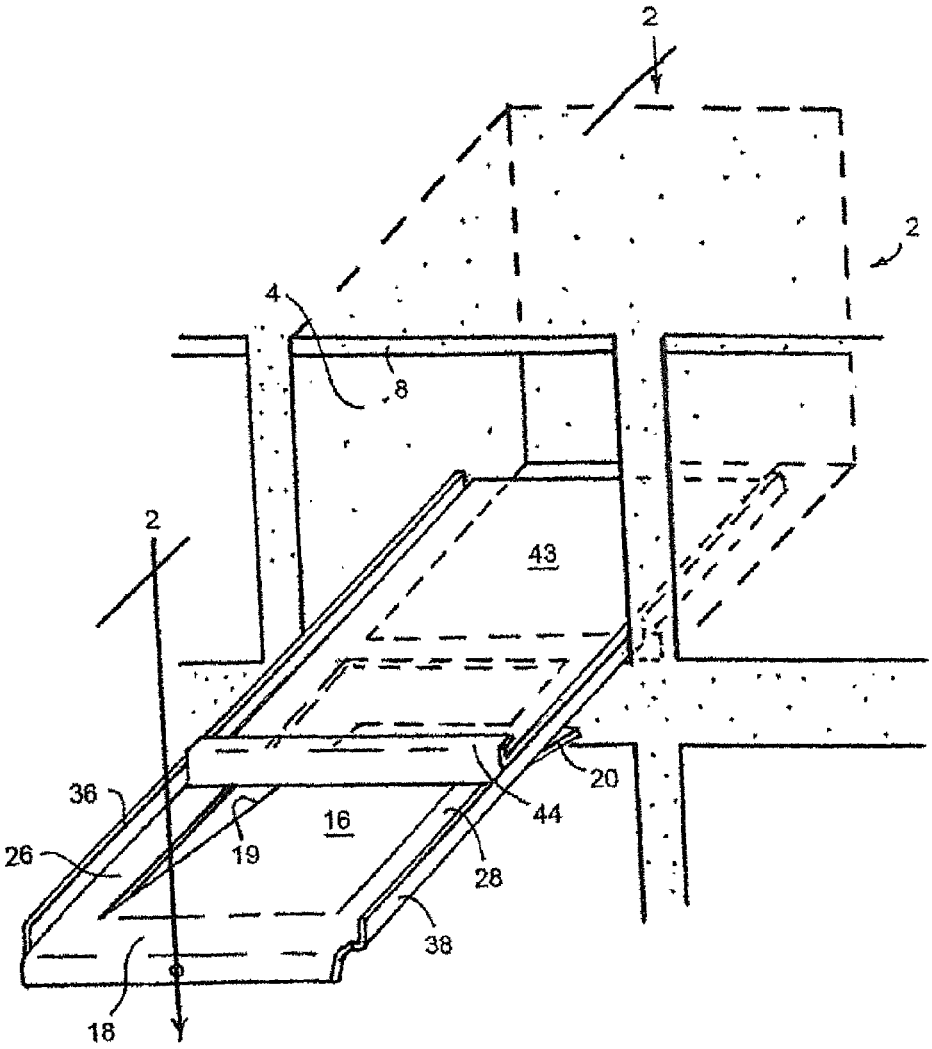
FIG. 1 is a perspective view of the inurnment system of the present invention attached to a typical columbarium niche.
Figure 2:
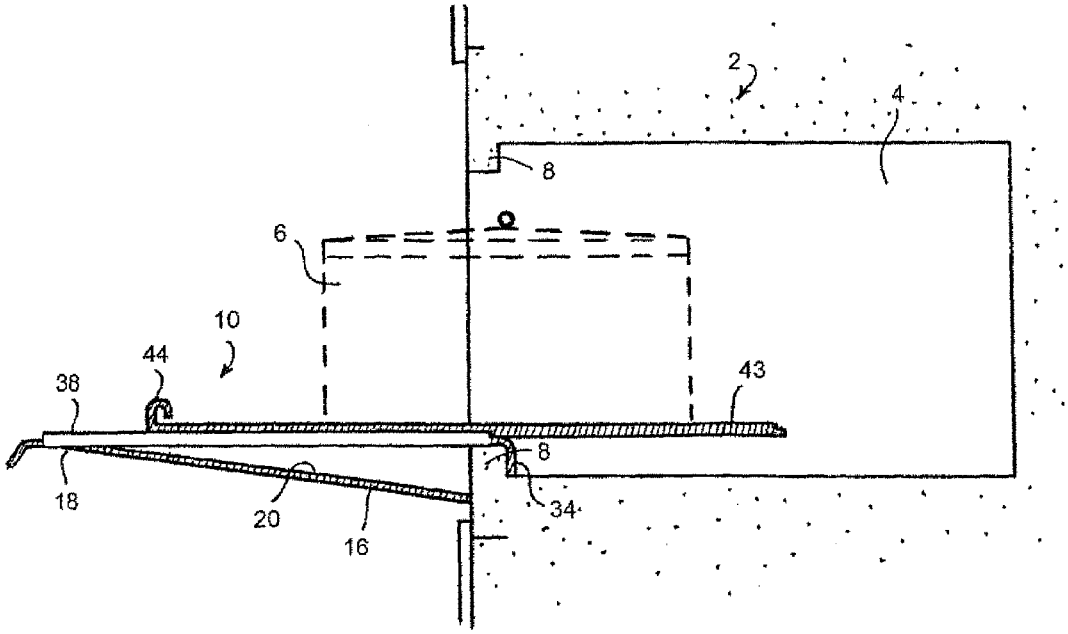
FIG. 2 is a cross sectional view taken along lines 2-2 in FIG. 1 with a typical crematory urn shown in dotted lines.

A typical columbarium niche 2 is shown in FIGS. 1 and 2 and comprises an interior cavity 4 into which a crematory urn 6 is intended to be placed. The niche is provided with a frame 8 around its front opening.

Figure 3:
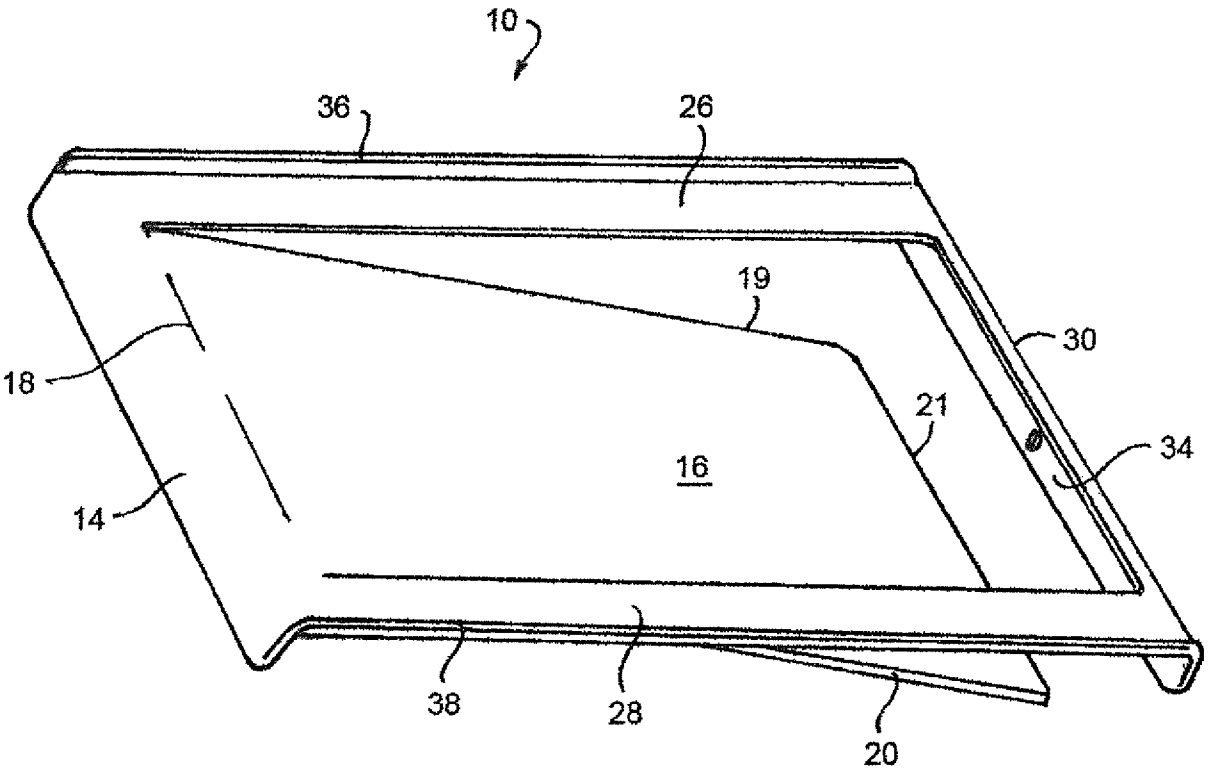
FIG. 3 is a perspective view of the bracket of the system.
Figure 4:
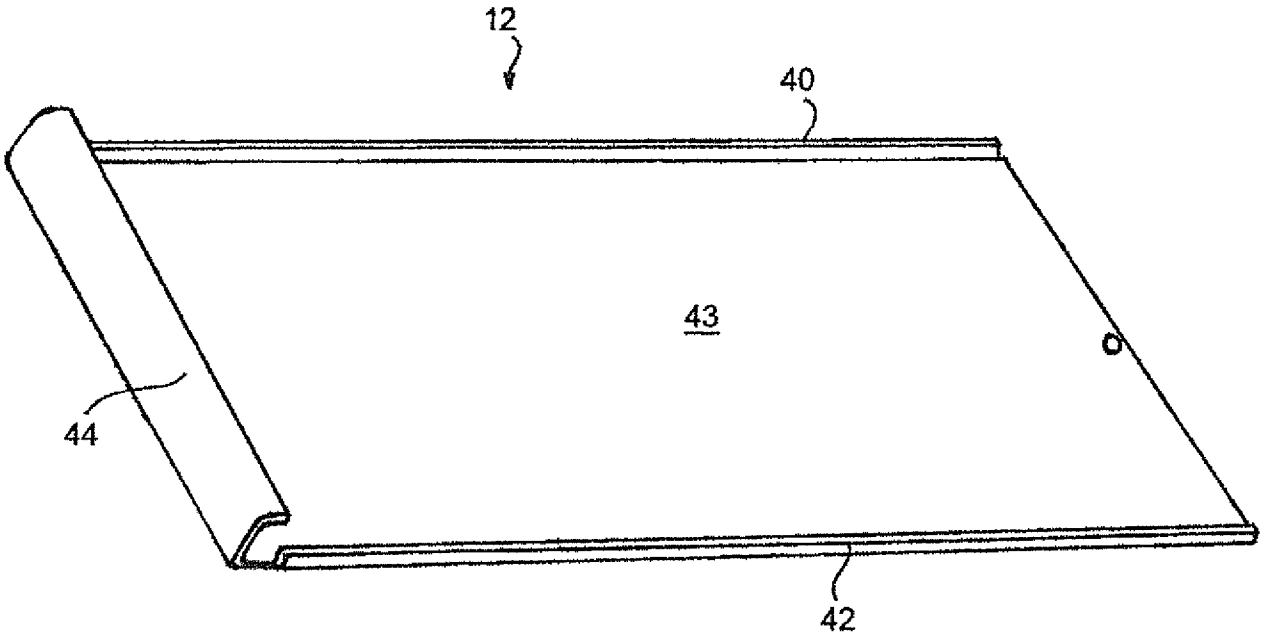
FIG. 4 is a perspective view of the sled that directly supports the crematory urn and slides on the upper surface runners of the bracket.

The inurnment system of the present invention comprises two components, a bracket 10 and a sled 12 as shown respectively in FIGS. 3 and 4.

The bracket 10 includes a body 14 and a supporting leg forming tongue 16. The supporting leg is rectangular in shape, one narrow end 18 of which is integral with the body 14 of the bracket. The other three sides 19, 20 and 21 of the solid rectangular leg 16 are formed by cutting through the body of the bracket and relieving each of the three edges of the leg 16 in order that the leg will elastically pivot about the edge 18 which is left integral with the bracket body 14. On each long side of the relieved rectangular leg, the laterally extending portions of the bracket body form support surfaces 26 and 28. The proximal end 30 of the bracket has a turned down edge forming a lip 34. Upturned edges 36 and 38 on the lateral sides of each of the surfaces 26 and 36 act to stiffen the structure and provide retaining lips to hold the sled 12 centered on the bracket.

The sled 12 is illustrated in FIG. 4 and includes a rigid flat body 43 having upturned side edges 40 and 42 and an integral handle portion 44. The lateral width of the sled, including the upturned sides 40 and 42, is dimensioned to fit between the upturned edges 36 and 38 of the bracket 10. The lateral sides of the under surface of the sled body 43 are slidingly supported by surfaces 26 and 28 of the bracket 10. The longitudinal length of the sled 12 is longer than the longitudinal length of the bracket 10 in order to carry the urn 6 well into the interior of the niche cavity.

It is seen in FIGS. 2 and 3 that the downwardly bent lip 34 of the bracket body is hooked over the edge of the niche facing frame 8. The supporting leg 16 of the bracket is pulled down at its proximal end 21 forcing the leg to pivot about its integral edge 18. The proximal end edge 21 of the leg is positioned against the facing frame of the niche, thus forming a structural triangle that will support the weight of a cremation urn placed on the sled. The sled 12 slides longitudinally backwards and forwards on the bracket support surfaces 26 and 36.

In operation, the sled 12 is placed on the supporting surfaces of the bracket with its handle 44 over the distal end of the bracket 10. A cremation urn 6 is placed on the sled. The sled is then moved forwardly into the interior 4 of the niche 2. With the urn being restrained from moving with the sled, the sled is slid rearwardly out of the niche, leaving the urn inside the cavity of the niche. The bracket is then lifted off of the facing edge of the niche and the niche is closed.

I claim:

1. An apparatus for transporting an urn into a columbarium having a wall and a niche having a facing frame comprising:

an elongated sheet of rigid material forming a bracket for temporary attachment to the wall of the columbarium and having load supporting spaced apart mutually parallel sides, each with distal and proximal ends, where the proximal ends include means for engaging the facing frame of the columbarium niche to support the proximal ends of the bracket, so that the parallel sides form a frame around a bracing leg that is partially relieved from the elongated sheet of rigid material;

the bracing leg being a flat, rectangular member having a first end and a second free end, wherein the first end is monolithic with the bracket at a hinged end and disposed between the spaced apart sides thereof, said bracing leg depending angularly from the distal end of the bracket where the free end engages the columbarium wall beneath the niche;

a platform slidably disposed on the parallel sides of the bracket for slidable movement lengthwise of the bracket from a position outside of the niche to a position inside the niche.

2. The apparatus of claim 1 where each of the parallel sides of the bracket include up-turned lateral outside edges.

3. The apparatus of claim 2 where the platform includes up-turned lateral outside edges.

4. The apparatus of claim 3 where the platform includes distal and proximal ends where the distal end includes an up-turned end forming a handle.

5. An apparatus for transporting an urn into a columbarium having a wall and a niche having a facing frame comprising:

a rectangular frame forming a bracket having distal and proximal ends for temporary attachment to the wall of the columbarium having, load-supporting spaced apart mutually parallel sides, a proximal end member interconnecting the parallel sides and including means for engaging the facing frame of the columbarium niche for supporting the proximal end of the bracket, a distal end member interconnecting the parallel sides, a rectangular flat bracing leg having first and second ends where the first end is monolithic and hinged with the distal end member and depends angularly therefrom and where the second end of the leg engages the columbarium wall beneath the niche, the leg being framed by the parallel sides and the proximal end member of the bracket, and a platform slidably disposed on the parallel sides of the bracket for slidable movement lengthwise of the bracket from a position outside of the niche to a position inside the niche.

* * * * *